US005709540A

United States Patent [19]

Cadeddu

[11] Patent Number: 5,709,540

[45] Date of Patent: Jan. 20, 1998

[54] ROTARY PUMP WITH SINGLE ELASTIC VANE

[75] Inventor: Leonardo Cadeddu, Crema, Italy

[73] Assignee: Robert Bosch Sistemi Frenanti Spa, Crema, Italy

[21] Appl. No.: 624,600

[22] PCT Filed: Mar. 11, 1996

[86] PCT No.: PCT/EP96/01031

§ 371 Date: Apr. 10, 1996

§ 102(e) Date: Apr. 10, 1996

[87] PCT Pub. No.: WO96/33339

PCT Pub. Date: Oct. 24, 1996

[30] Foreign Application Priority Data

Apr. 19, 1995 [IT] Italy ..... TO95A0310

[51] Int. Cl.[6] ..... F04C 2/344

[52] U.S. Cl. ..... 418/156; 418/258

[58] Field of Search ..... 418/156, 257, 418/258

[56] References Cited

U.S. PATENT DOCUMENTS

| | | | |
|---|---|---|---|
| 1,421,766 | 7/1922 | Edwards | 418/258 |
| 1,728,620 | 9/1929 | Lateur | 418/255 |
| 2,077,394 | 4/1937 | Buenger | 418/258 |
| 2,436,876 | 3/1948 | Stamsvik | 418/258 |

FOREIGN PATENT DOCUMENTS

| | | | |
|---|---|---|---|
| 2256683 | 7/1975 | France . | |
| 2326508 | 12/1974 | Germany | 418/258 |
| 1543124 | 2/1990 | U.S.S.R. | 418/156 |

*Primary Examiner*—John J. Vrablik
*Attorney, Agent, or Firm*—Leo H. McCormick, Jr.

[57] ABSTRACT

A rotary pump having a stator (1) pierced with a housing (11) delimited by a cylindrical sidewall (110). A cylindrical rotor (2) located tangentially inside of the housing (11) off-center to an axis (X). The cylindrical rotor (2) is driven in rotation about the axis (X). A vane which diametrally passes through the rotor (2) has first and second opposite edges (31,32). The first and second opposite edges (31,32) bear against the sidewall (110) and are separated from one another by a distance subjected to variations during rotation of the rotor (2). The vane (3) is made of a thin sheet of material which offers elastic resistance to bending. The thin sheet has an undulation part (33,34) which absorbs such variations in distance experienced by the first and second opposite edges (31,32) of the vane (3).

6 Claims, 2 Drawing Sheets

ROTARY PUMP WITH SINGLE ELASTIC VANE

The present invention relates to a rotary pump comprising a stator pierced with a housing delimited by a cylindrical sidewall, a cylindrical rotor located inside the housing, tangential thereto and capable of being driven in rotation about an axis which is off-centered relative to this housing, and a vane passing diametrally through the rotor in order to be rotationally interdependent therewith, and exhibiting two opposite edges bearing against the sidewall of the housing and separated from one another by a distance subjected to variations as the rotor rotates, this vane itself including elastic means capable of absorbing these variations.

BACKGROUND OF THE INVENTION

Rotary pumps are known and have been used for many decades for multiple applications, and a pump of the previously-defined type is described, for example, in Patent Document FR-2,256,683.

It is also well known to those skilled in the art that pumps of this type deliver an output which depends in particular on the eccentricity of the rotor relative to the stator, the output being greater the higher this eccentricity.

Nevertheless, the problem conventionally posed in the design of pumps with optimized output lies in the fact that the distance between the opposite edges of the vane exhibits variations which are themselves greater, the higher the eccentricity of the rotor relative to the stator, and that it becomes very difficult to compensate for these variations, particularly if the drive torque of the pump is to remain limited to a low value.

SUMMARY OF THE INVENTION

In this context, the object of the present invention is to provide a vacuum pump of the rotary type, in which these difficulties are overcome.

To this end, the pump of the invention, otherwise in accordance with the general description thereof which is given hereinabove, is essentially characterized in that the vane at least partially assumes the form of a thin sheet of a material offering elastic resistance to bending, and in that the elastic compensation means comprise at least one undulation of this thin sheet.

For preference, the rotor is hollow and exhibits two guide slots oriented diametrally and through which the vane passes, the undulation in the thin sheet being accommodated inside the rotor.

According to an advantageous embodiment of the invention, the opposite edges of the vane may consist of folds of the thin sheet on itself.

The pump of the invention is driven, for example, by rotating a drive shaft coaxially secured to the rotor, passing through an axial wall of the stator and exhibiting a drive relief accessible on the outside of the housing.

Other features and advantages of the invention will emerge clearly from the description thereof given hereafter by way of non-limiting indication with reference to the appended drawings.

DETAILED DESCRIPTION OF THE DRAWINGS

Figure 1:
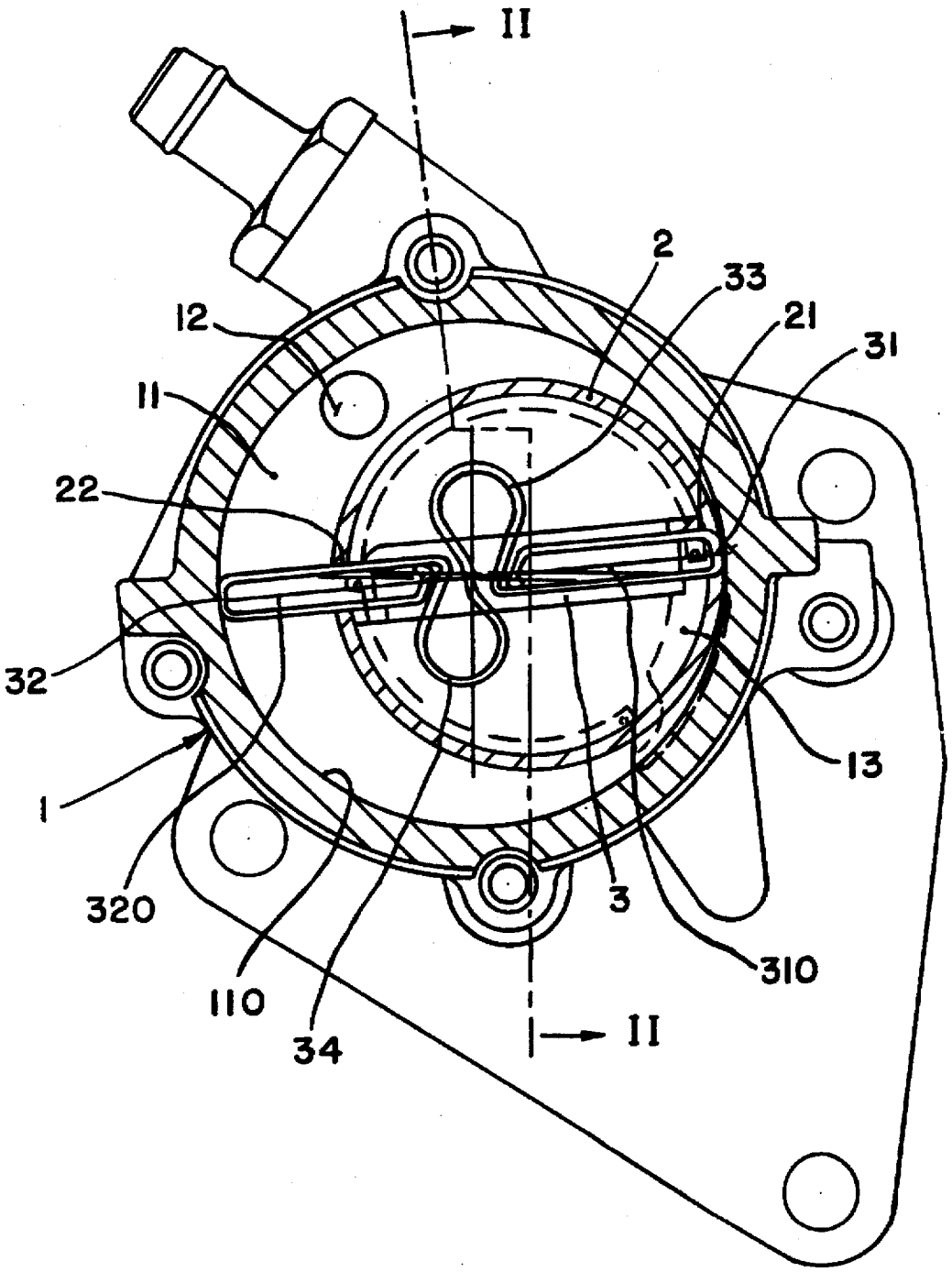
FIG. 1 is a sectional view of a pump in accordance with the invention, the section being taken perpendicularly to the axis of rotation of the rotor.
Figure 2:
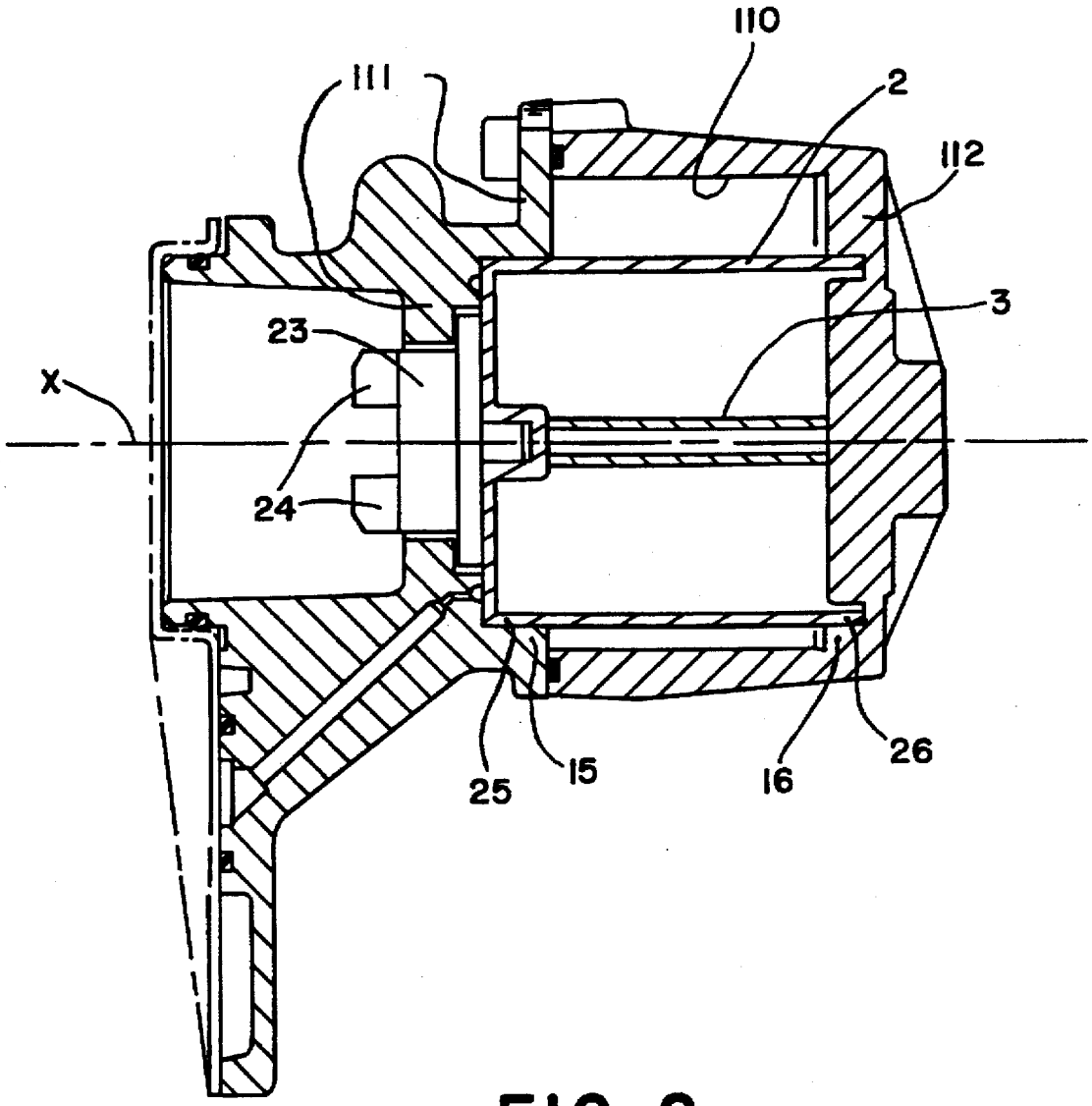
FIG. 2 is a sectional view on II—II of FIG. 1.

The invention relates to a rotary pump which can be used as a pneumatic vacuum pump, essentially comprising a stator 1, a rotor 2, and a single vane 3.

The stator 1 is pierced with a housing 11 delimited by a cylindrical sidewall 110 and by two axial walls 111, 112, an inlet 12 for drawing in air and an outlet 13 for exhausting air emerging in the housing 11.

The rotor 2 is itself cylindrical, located inside the housing 11, and in tangential and sealed contact therewith, and secured to a coaxial driving piece 23 passing through the axial wall 111 of the stator and exhibiting a driving relief 24 accessible on the outside of the housing, so as to allow the rotor to be driven in rotation about an axis X which is off-centered relative to the housing 11.

Moreover, the rotor is guided on the outer edges 25 and 26 of its periphery by complementary bearings 15, 16 of the stator.

The vane 3 passes diametrally through the rotor in order to be rotationally interdependent therewith, and exhibits two opposite edges 31 and 32 bearing against the sidewall 110 of the housing 11 and separated from one another by a distance subjected to variations as the rotor 1 rotates.

In order to absorb these variations, the vane 3 of the pump according to the invention at least partially assumes the shape of a thin sheet made of a material offering elastic resistance to bending, for example spring steel, this thin sheet furthermore forming at least one undulation, such as 33, 34.

For preference, the rotor 1 is hollow and exhibits two guide slots 21, 22 oriented diametrally and through which the vane 3 passes, the undulated part 33, 34 of this vane being accommodated inside the rotor.

As FIG. 1 shows, the opposite edges 31, 32 of the vane may quite simply be formed of folds of the thin sheet of which the vane is constructed, each of these folds extending as far as inside the guide slot 21, 22 which corresponds to it and delimiting an empty space 310, 320 capable of constituting a labyrinth barrier to the differential pressure to which this fold is subjected.

I claim:

1. A rotary pump comprising a stator pierced with a housing delimited by a cylindrical sidewall, a hollow cylindrical rotor tangentially located inside said housing, said rotor being driven in rotation about an axis which is off-centered relative to said housing, and said rotor having first and second diametrally oriented guide slots, and a vane passing diametrally through said guide slots and rotationally interdependent with said rotor, said vane having first and second opposite edges bearing against said sidewall of said housing, said first and second opposite edges being separated by a distance subjected to variations as said rotor rotates, said vane having at least one undulation of a thin sheet of material which offers elastic resistance to bending for absorbing such variations, said first and second opposite edges of the vane each consisting of folds in said thin sheet, said folds on said first edge extending into said first guide slot and said folds on said second edge extending into said second guide slot, said folds delimits an empty space capable of constituting a labyrinth barrier for a differential pressure developed across said vane.

2. The rotary pump according to claim 1 wherein said undulation is located inside of said rotor.

3. The rotary pump according to claim 1 wherein said rotor is rotationally interdependent with a driving component which passes through an axial wall of said stator and which has a driving relief accessible on the outside of said housing.

4. The rotary pump according to claim 1 wherein said rotor is guided on periphery outer edges by bearings of said stator.

5. The rotary pump according to claim 2 wherein said rotor is rotationally interdependent with a driving component which passes through an axial wall of said stator and which has a driving relief accessible on the outside of said housing.

6. The rotary pump according to claim 2 wherein said rotor is guided on periphery outer edges by bearings of said stator.

* * * * *